United States Patent [19]

Matsuo et al.

[11] Patent Number: 4,929,209

[45] Date of Patent: May 29, 1990

[54] METHOD OF AGING CATHODE-RAY TUBE

[75] Inventors: Teruo Matsuo; Tadayoshi Ihara; Yoshinori Oyamada, all of Mobara, Japan

[73] Assignee: Hitachi, Ltd., Tokyo, Japan

[21] Appl. No.: 225,352

[22] Filed: Jul. 28, 1988

[30] Foreign Application Priority Data

Sep. 18, 1987 [JP] Japan ..... 62-232158

[51] Int. Cl.[5] ..... H01J 9/00

[52] U.S. Cl. ..... 445/6; 445/5

[58] Field of Search ..... 445/5, 6

[56] References Cited

U.S. PATENT DOCUMENTS

| | | | |
|---|---|---|---|
| 3,357,766 | 12/1967 | Conger, Jr. | 445/6 |
| 3,966,287 | 6/1976 | Liller | 445/5 |
| 4,052,776 | 10/1977 | Maskell | 445/5 |
| 4,214,798 | 7/1980 | Hopen | 445/5 |
| 4,395,242 | 7/1983 | Liller | 445/5 |
| 4,457,731 | 7/1984 | Patrickson | 445/6 |
| 4,515,569 | 5/1985 | Hernqvist | 445/6 |
| 4,682,962 | 7/1987 | Hata | 445/5 |
| 4,682,963 | 7/1987 | Daldry | 445/6 |

FOREIGN PATENT DOCUMENTS

| | | | |
|---|---|---|---|
| 0097231 | 5/1987 | Japan | 445/6 |

*Primary Examiner*—Kurt Rowan

*Attorney, Agent, or Firm*—Antonelli, Terry, Stout & Kraus

[57] ABSTRACT

For aging a cathode-ray tube which has a cathode capable of emitting an electron beam, a first electrode for limiting the electron beam, a second electrode for accelerating electrons of the limited electron beam, a third electrode for focusing the accelerated electron beam and an anode, the cathode is energized so that an electron beam is emitted therefrom while D.C. rated voltages are applied to the first and second electrodes, respectively, and first and second voltages are applied to the third electrode and the anode, respectively, for a predetermined time. The first and second voltages are time-varying within first and second zones each of which is between a first level lower than the D.C. rated voltage on the second electrode and a second level higher than the highest one of the voltages on the third electrode with which an electric current flows in the second electrode with the electron beam emitted from the cathode. The first time-varying voltage is in phase with and lower than the second time-varying voltage. The first time-varying voltage is varying so as to be at a level between the first and second levels at least for a part of the above-mentioned predetermined time.

6 Claims, 1 Drawing Sheet

METHOD OF AGING CATHODE-RAY TUBE

BACKGROUND OF THE INVENTION

The present invention relates to an aging method suitable for a cathode-ray tube (CRT), especially, a large-area color picture tube or CRT, so that cold emission from an accelerating electrode upon actual use of the CRT can be reduced.

In recent years, there is seen an increasing tendency of color CRT's to large-sized ones and the application of relatively high voltages to an anode and a focusing electrode (usually, a $G_3$ electrode) is required in order to suppress the lowering of the luminance of pictures resulting from an increase of the size of a screen of the CRT. As a result, even little contamination of electrodes is liable to cause cold emission therefrom so that the quality of an image or a picture displayed on the CRT screen may be deteriorated. Namely, even under a condition of operation in which the emission of a thermoelectron beam is cut off by a $G_1$ electrode, electrons produced by the cold emission may excite phosphor substances on a phosphor screen of the CRT into fluorescence, thereby lowering the contrast of an image displayed. Also, the cold emission is one factor of a discharge in the tube and a strong discharge undesirably brings about a failure of a CRT driver circuit.

Usually, the cold emission generates concentratedly from a location at which the strength of an electric field is high. Therefore, a main source of the cold emission is a focusing electrode system to which a high voltage is applied. However, as the requirements for improvement on the quality of the CRT tube becomes severe, there has been increased the need of having another look at cold emission from a $G_2$ electrode to which a low voltage is applied, though it was a common knowledge that the cold emission from the $G_2$ electrode is rather low.

One of conventional methods of reducing the cold emission from the $G_2$ electrode has been disclosed by JP-A-57-67261 laid open on Apr. 23, 1982, entitled "Method of Manufacturing Cathode-Ray Tube". In the disclosed method, the $G_2$ electrode is cleaned by irradiating the vicinity of an opening of the $G_2$ electrode with an electron beam during a process step for manufacture of the CRT. In this case, constant D.C. voltages are applied to various electrodes. Therefore, respective optimum voltage conditions must be established for different types of CRT's. The abovementioned cleaning process for the $G_2$ electrode is one of kind of aging. As is well known, "aging" is a general term for a process for stabilization of the electron emitting characteristics of a cathode, a process for cleaning of the surface of each electrode, and so on which are carried out in a process step for manufacture of an electron tube in order that the electron tube can maintain a satisfactory operation over a long period of time in its practical use. The JP-A-57-67261 does not refer to undesirable influence of the bombardment of an accelerated electron beam on an opening of the focusing electrode system.

JP-A-57-38538 laid open on Mar. 3, 1982, entitled "Method of Aging Color CRT" has disclosed an aging method in which methane in gases emitted from electrodes in a CRT is ionized by the action of an electron beam during a process called "raster aging" in order to provide an ionized version of the methane liable to be absorbed by a barium getter, thereby improving the degree of vacuum in the tube and reducing a possibility that the surface of a cathode may be damaged by the impingement of gaseous ions thereagainst upon actual use of the CRT. In this aging method, too, D.C. voltages are applied to respective electrodes so that the electron beam impinges upon the electrodes uniformly at all times or only fixed locations thereof. Also, the JP-A-57-38538 refers to neither the cleaning of a $G_2$ electrode nor the reduction of cold emission therefrom.

SUMMARY OF THE INVENTION

The present invention is based on the present inventors'recognition that a cause of cold emission from a $G_2$ electrode or accelerating electrode in a CRT lies in that a cathode material or thermoelectron emitting material (for example, Ba) of the surface of a cathode evaporates during a process for activation of the cathode or the like and adheres to the wall of an opening of the accelerating electrode and/or the vicinity thereof.

An object of the present invention is to provide an aging method for a CRT by which cold emission from an accelerating electrode of the CRT can be reduced.

According to one aspect of the present invention, for aging a CRT having in an envelope a cathode capable of emitting an electron beam, a first electrode for limiting the electron beam, a second electrode for accelerating electrons of the limited electron beam, a third electrode for focusing the accelerated electron beam, and an anode, the cathode is energized with the first and second electrodes applied with D.C. voltages substantially equal to respective rated voltages for the first and second electrodes, thereby causing an electron beam to be emitted from the cathode and first and second time-varying voltages are applied to the third electrode and the anode, respectively, for a predetermined time. The first and second voltages are time-varying within first and second zones each of which is between a first level lower than the D.C. rated voltage on the second electrode and a second level higher than the highest one of voltages on the third electrode with which an electric current flows in the second electrode with the electron beam emitted from the cathode. The first time-varying voltage is in phase with and lower than the second time-varying voltage. The first time-varying voltage is varying so as to be at a level between the first and second levels at least for a part of the predetermined time.

According to another aspect of the present invention, heater is applied and heated with a D.C. or A.C. voltage equal to or near a rated voltage for the heater, a cathode is grounded to a zero potential directly or through a resistor. A beam limiting electrode is applied with a zero potential or a negative D.C. voltage with which a thermoelectron beam is not cut off and an accelerating electrode is applied with a D.C. voltage near a rated voltage for the accelerating electrode, so that an electron beam is emitted from the cathode. An anode and an electrode (usually, a $G_4$ electrode) connected to the anode through an inner conductor film in the tube are applied with voltages which are time-varying (for example, changes periodically) between the lowest peak voltage lower than the voltage applied to the accelerating electrode and the highest peak voltage of 3 KV to 5 KV. A focusing electrode (usually, a $G_3$ electrode) is applied with a voltage which is lower than the voltage applied to the anode (for example, about 70% to 80% of the anode voltage) and is time-varying in phase with the same phase as the anode voltage.

Under the above-mentioned voltage condition, though the electron beam emitted from the cathode reaches a phosphor screen in a state in which positive voltages are applied to the anode and the focusing electrode, the degree of focusing of the electron beam is not sharp since the value of the voltage applied to the anode is far lower than the rated voltage (for example, 20 KV to 30 KV) for the anode. Accordingly, not only the kinetic energy of electrons upon arrival thereof to the phosphor screen but also the density of electrons in the electron beam are low. Therefore, no burning of the phosphor screen takes place even if the electron beam is not deflected. Under this condition similar to the "raster aging" employed in the above-mentioned JP-A-57-38538, a hydrocarbon gas is ionized by the electron beam to change it from a usual state in which it cannot be absorbed by a barium getter to a state in which it can be easily absorbed by the barium getter, thereby improving the degree of vacuum in the tube. Also, in a state in which the voltages applied to the anode and the focusing electrode or $G_3$ electrode are lower than the voltage applied to the $G_2$ electrode, the electron beam is cut off from the phosphor screen and impinges upon a surface of the $G_2$ electrode on the cathode side. Further, since the voltages applied to the anode and the focusing electrode vary between a voltage lower than the accelerating electrode voltage and a voltage of 3 KV to 5 KV, an intermediate transient state necessarily appears between the state in which the electron beam impinges upon the surface of the $G_2$ electrode on the cathode side and the state in which the electron beam reaches the phosphor screen. In this intermediate transient state, the electron beam impinges upon the wall of an opening of the accelerating electrode which in turn is cleaned.

DESCRIPTION OF THE PREFERRED EMBODIMENTS

In a general process for manufacture of a color CRT, a panel having a phosphor film formed on the inner surface thereof and a shadow mask attached thereto is bonded to a funnel portion of a bulb having a conductor film applied on the inner surface thereof. Subsequently, a stem having an electron gun mounted thereon is sealed to a neck portion of the bulb. Then, a gas in the tube is exhausted, thereby providing an apparently complete product. However, the electrical characteristics of the product as a CRT remain unsatisfactory. For improving the electrical characteristics up to a level of the final product is required an aging process which includes, as its purposes, (1) thermally decomposing a thermoelectron emitting material of a cathode to reduce a part thereof to a substance such as barium capable of readily emitting electrons therefrom, (2) impinging an electron beam upon electrodes in the tube to decompose and let free any contamination and gas adhered to the electrodes so that the free contamination and gas are absorbed by a getter, (3) ionizing by an electron beam bombardment a hydrocarbon gas such as methane which is present in the tube and cannot be absorbed by a getter and causing the ionized hydrocarbon gas to be absorbed by the getter, (4) applying to an anode a voltage not lower than a rated voltage for the anode with a cathode remained cold or being not heated, thereby to generate arc discharges at minute projections, contamination or the like of electrodes opposing the anode so that those portions where electric fields are concentrated are decomposed and smoothed by ion bombardment (knocking), and (5) stabilizing the thermoelectron emitting characteristic of a cathode. A main object of the present invention concerns the above-mentioned purpose (2) and the improvement on the performance of a CRT depending on the aging process is made by the employment of the present invention alone or in combination with one of the conventional methods.

Figure 1:
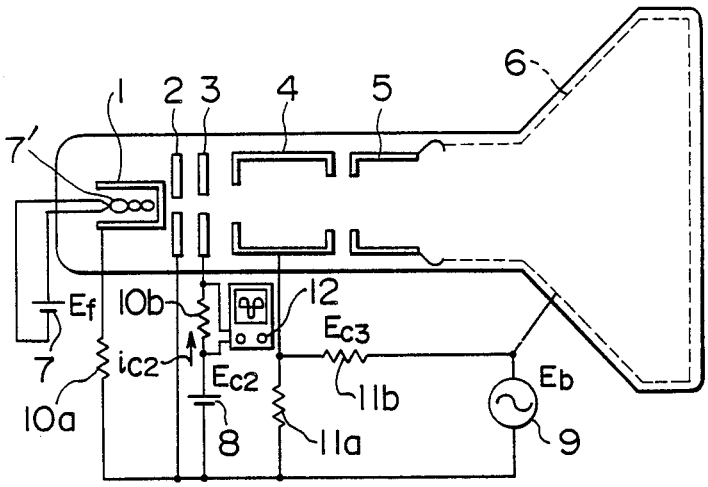
FIG. 1 shows a circuit diagram for explaining an embodiment of the present invention.

Referring to FIG. 1 which shows a circuit diagram for explaining an aging method according to an embodiment of the present invention, thermoelectrons emitted from a cathode 1 heated by a heater 7' connected to a power source 7 for the heater are accelerated by a $G_2$ electrode (or accelerating electrode) 3 applied with a voltage $Ec_2$ of a power source 8 for the $G_2$ electrode (or accelerating electrode) and reaches the $G_2$ electrode 3 in the form of an electron beam. Current limiting resistors 10*a* and 10*b* are provided for limiting the electron beam so as to prevent the amount of electrons in the electron beam from being excessive. An oscilloscope 12 is provided for dynamically measuring the amount of electrons which are intercepted by the $G_2$ electrode 3. This measurement is made by virtue of a voltage drop across the current limiting resistor 10*b*. In the conventional method, the electron beam passes through an opening of the $G_2$ electrode 3 in the case where a high D.C. voltage is applied to an anode 6 or a $G_3$ electrode (focusing electrode) 4. Also, in the case where no voltage is applied to the anode 6 and the focusing electrode 4, the electron beam dominantly impinges upon a surface a' of the $G_2$ electrode 3 opposing a $G_1$ electrode 2 (or a control electrode for limiting the electron beam), as shown by dotted line a in FIG. 2 and hence the electron beam does not almost reach the inner wall b' of the opening of the $G_2$ electrode 3 which may cause cold emission giving rise to trouble in an operation of the CRT upon its actual use. A voltage Eb of a high voltage source 9 is applied to the anode 6 and a $G_4$ electrode 5 as it is, and is applied to the focusing electrode or $G_3$ electrode 4 as a focusing electrode voltage $Ec_3$ through potentiometers 11*a* and 11*b*. The potentiometers 11*a* and 11*b* are shown as convenient means for obtaining the focusing electrode voltage. Alternatively, an independent power source may be provided for supplying the focusing electrode voltage $Ec_3$. In that case, the voltage Ec supplied from the independent power source to the focusing electrode should be in phase with and lower than the voltage Eb applied to the anode 6.

As will be hereinafter explained in detail with reference to FIGS. 3 and 4, the voltages $Ec_3$ and Eb are time-varying ones with their widths of variation within respective different zones each of which is between a first level lower than the $G_2$ electrode (or accelerating electrode) voltage $Ec_2$ and a second level higher than the highest one of voltages on the focusing electrode 3 with which an electric current flows in the $G_2$ electrode with an electron beam emitted from the cathode 1.

In the present embodiment, the voltage Eb may be an A.C. voltage or a voltage the waveform of which may be arbitrary so long as it varies between a voltage sufficiently low as compared with the $G_2$ electrode voltage $Ec_2$ and a voltage of 3 KV to 5 KV. Here, the voltage Eb has a half-wave rectified waveform of a commercial frequency as shown in FIG. 3.

In the case where the focusing electrode voltage $Ec_3$ is sufficiently higher than the accelerating electrode voltage $Ec_2$, the electron beam passes through openings of the $G_3$ electrode (or focusing electrode) 4 and the $G_4$ electrode 5 and reaches the anode 6 or the phosphor screen. In this state corresponding to the "raster aging" disclosed in the above-mentioned JP-A-57-38538, gases are released from a shadow mask and the phosphor screen and a hydrocarbon gas in the already discharged gases is decomposed. The focusing electrode voltage $Ec_3$ is selected to be lower than the anode voltage Eb, as has already been mentioned. This requirement results in the formation an electronic lens to converge the electron beam which otherwise becomes too extensive upon passing through the $G_3$ electrode 4 and the $G_4$ electrode 5 so that the electron beam impinges against the inner walls of the openings of the electrodes 4 and 5 which in turn are burnt and damaged.

Figure 2:
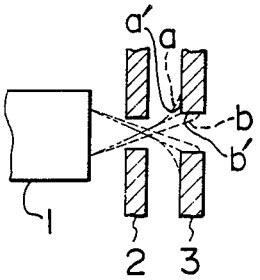
FIG. 2 is a view for explaining effects of the present invention.

In the case where the $G_3$ electrode or focusing electrode voltage $Ec_3$ is lower than the $G_2$ electrode or accelerating electrode voltage $Ec_2$, the electron beam is cut off from the $G_3$ electrode 4 so that it impinges upon a surface a' of the $G_2$ electrode 3 facing the $G_1$ electrode 2, as shown by dotted line a in FIG. 2.

In a transient state in which the focusing electrode voltage $Ec_3$ takes values which are between the above-mentioned two cases or between a value sufficiently higher than $Ec_2$ and a value lower than $Ec_2$, the electron beam impinges upon the inner wall b' of the opening of the $G_2$ electrode 3, as shown by dotted line b in FIG. 2, thereby allowing the cleaning of the inner wall portion of the opening of the $G_2$ electrode 3.

In the case where the anode voltage Eb and the focusing electrode voltage $Ec_3$ are set to respective specified values, as shown in the above-mentioned JP-A-57-67261, it is possible to stationarily yield a state of the electron beam shown by dotted line b in FIG. 2. However, the condition of electrode voltages optimum for the cleaning of the inner wall of the opening of the $G_2$ electrode is limited to a relatively narrow range and is different for every type of CRT. Further, unless a suitable voltage condition is established, there is a danger that the focusing electrode may be burnt and damaged. Accordingly, it is difficult to implement the optimum voltage condition for the cleaning of the inner wall of the opening of the $G_2$ electrode by only the D.C. voltage source(s).

On the other hand, if an electrode voltage source capable of supplying a time-varying voltage is used in accordance with the teaching of the present invention, it is not necessary to establish a troublesome voltage condition since a state shown by dotted line b in FIG. 2 necessarily exists as one of transient states. Further, since the anode voltage and the focusing electrode voltage may have a recurrently rising and falling waveform, there can be avoided a danger that the focusing electrode may be burnt and damaged in the case where high D.C. voltages are applied to the anode and the focusing electrode.

Figure 4:
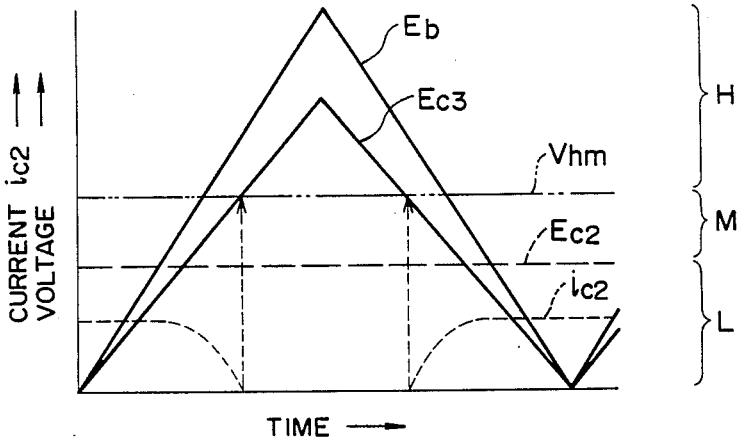
FIG. 4 shows other examples of voltage waveforms applied to the anode and the focusing electrode.

FIG. 4 shows other examples of waveforms of the anode electrode voltage Eb and the focusing electrode voltage $Ec_3$ In the figure, a region L where the focusing electrode voltage $Ec_3$ is lower than the $G_2$ electrode voltage $Ec_2$, corresponds to a state shown by dotted line a in FIG. 2 and is therefore ineffective for the cleaning of the inner wall of the opening of the $G_2$ electrode which cleaning is aimed by the present invention. A region H where the focusing electrode voltage $Ec_3$ is higher than a focusing electrode voltage $V_{hm}$ causing an electric current $i_{c3}$ to flow in the $G_2$ electrode and hence no electron beam impinges upon the $G_2$ electrode, is fully ineffective for the cleaning of the $G_2$ electrode. Accordingly, an intermediate region M between the regions L and H is effective for the cleaning of the inner wall b' (see FIG. 2) of the opening of the $G_2$ electrode. The boundary voltage $V_{hm}$ between the regions H and M is determined by measuring the $G_2$ electrode current $i_{c3}$ by use of the oscilloscope 12. It should be noted that determination of the boundary voltage $V_{hm}$ on the basis of design constants is not possible without difficulty.

Figure 3:
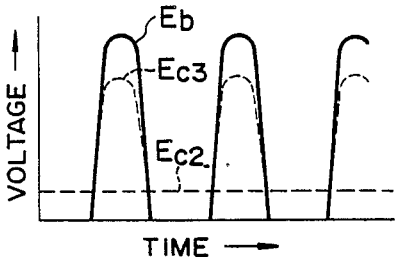
FIG. 3 shows examples of voltage waveforms applied to an anode and a focusing electrode.

An effect intended by the present invention can be achieved by letting each of the anode voltage Eb and the focusing electrode voltage $Ec_3$ have a waveform (square waveform, triangular waveform, sawtooth waveform, or the like) which is time-varying within a zone identical with the region M shown in FIG. 3 or within any zone including the region M (a zone consisting of at least a portion of region H and at least a portion of region M, a zone consisting of at least a portion of region M and a portion of region L, or a zone including at least a portion of region L, region M and at least a portion of region of H). The use of the voltage waveform time-varying over the range including all the regions L, M and H is preferable for attaining the intended effect with certainty.

In the present embodiment, the anode voltage Eb varying between 0 V and 4 KV, the focusing electrode voltage $Ec_3$ varying between 0 V and 3 KV, the $G_2$ electrode voltage $Ec_2$ of 300 V and the heater voltage Ef of 6.3 V were used for a CRT in which the rated values of the anode voltage, the focusing electrode voltage, the $G_2$ electrode voltage and the heater voltage are 30 KV, 7 KV, 600 V and 6.3 V, respectively.

We claim:

1. A method of aging a cathode-ray tube having a cathode capable of emitting an electron beam, a first electrode for limiting said electron beam, a second electrode for accelerating electrons of the limited electron beam, a third electrode for focusing the accelerated electron beam and an anode, all being housed in an envelope, the method comprising the steps of:

energizing said cathode so that an electron beam is emitted therefrom with D.C. voltages applied to said first and second electrodes, the applied D.C. voltages being substantially equal to respective rated voltages for said electrodes; and applying first and second voltages to said third electrode and said anode for a predetermined time, respectively, said first and second voltages being time-varying within first and second zones, each of said zones being between a first level lower than said D.C. voltage to be applied to said second electrode and a second level higher than the highest one of voltages on said third electrode with which an electric current flows in said second electrode with said electron beam emitted from said cathode, said first time-varying voltage being in phase with and lower than said second time-varying voltage, said first time-varying voltage varying so as to be at a level between said first and second levels at least for a part of said predetermined time.

2. A method according to claim 1, in which said first time-varying voltage to be applied to said third electrode has its minimum value lower than said D.C. voltage to be applied to said second electrode.

3. A method according to claim 1, in which said first time-varying voltage to be applied to said third electrode has its maximum value higher than said highest one of voltages on said third electrode with which an electric current flows in said second electrode with said electron beam emitted from said cathode.

4. A method according to claim 1, in which said first time-varying voltage to be applied to said third electrode has its minimum value lower than said D.C. voltage on said second electrode and has its maximum value higher than said highest one of voltages on said third electrode with which an electric current flows in said second electrode.

5. A method according to claim 1, in which said first time-varying voltage to be applied to said third electrode is substantially 70% to 80% of said second time-varying voltage to be applied to said anode.

6. A method according to claim 1, in which each of said first and second time-varying voltages has a recurrent waveform.

* * * * *